US007694951B2

(12) United States Patent
Shiohara

(10) Patent No.: US 7,694,951 B2
(45) Date of Patent: Apr. 13, 2010

(54) SHEET FEEDER INCLUDING A PLURALITY OF PAPER CASSETTES

(75) Inventor: Yukio Shiohara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 113 days.

(21) Appl. No.: 11/536,634

(22) Filed: Sep. 28, 2006

(65) Prior Publication Data

US 2007/0075477 A1 Apr. 5, 2007

(30) Foreign Application Priority Data

Sep. 30, 2005 (JP) ..... 2005-286389

(51) Int. Cl.
*B65H 3/44* (2006.01)

(52) U.S. Cl. ..... 271/9.08; 271/9.07; 271/162

(58) Field of Classification Search ..... 271/9.08, 271/158, 9.07, 162
See application file for complete search history.

(56) References Cited

U.S. PATENT DOCUMENTS 4,017,181 A * 4/1977 Komaba et al. ..... 355/72
4,196,898 A * 4/1980 Misawa et al. ..... 271/9.08
4,449,705 A 5/1984 Shibuya et al.
4,540,297 A 9/1985 Imaizumi et al.
4,632,377 A * 12/1986 Browse ..... 271/9.08
4,660,820 A * 4/1987 Shino et al. ..... 271/9.08
4,991,830 A * 2/1991 Yamanaka ..... 271/9.08
5,085,421 A * 2/1992 Sellers ..... 271/155
5,102,112 A * 4/1992 Takahashi ..... 271/9.08
5,116,034 A * 5/1992 Trask et al. ..... 271/2
5,120,040 A 6/1992 Worley
5,201,506 A * 4/1993 Kushima et al. ..... 271/5
5,346,197 A * 9/1994 Takano et al. ..... 271/9.05
5,737,682 A 4/1998 Yamagishi
5,957,447 A * 9/1999 Sekine ..... 271/9.09
6,123,329 A * 9/2000 Sato et al. ..... 271/9.01

(Continued)

FOREIGN PATENT DOCUMENTS

JP H61-188336 A 8/1986

(Continued)

OTHER PUBLICATIONS

European Patent Office, European Search Report for Related EP Application No. 06020129, dated Jan. 10, 2007.

(Continued)

*Primary Examiner*—Patrick H Mackey
*Assistant Examiner*—Howard Sanders
(74) *Attorney, Agent, or Firm*—Baker Botts L.L.P.

(57) ABSTRACT

A sheet feeder includes a first sheet-feeding cassette capable of accommodating a stack of recording medium and a second sheet-feeding cassette capable of accommodating a stack of recording medium smaller than the recording medium accommodated in the first sheet-feeding cassette. The second sheet-feeding cassette is disposed on the first sheet-feeding cassette so as to be movable with respect to the first sheet-feeding cassette. The second sheet-feeding cassette includes a first accommodating section and a second accommodating section. The second accommodating section is displaceable relative to the first accommodating section between a closed position and an open position. The second accommodating section exposes an accommodating section of the first sheet-feeding cassette wider in the open position than in the closed position.

22 Claims, 11 Drawing Sheets

U.S. PATENT DOCUMENTS

| | | | | |
|---|---|---|---|---|
| 6,179,499 | B1 * | 1/2001 | Beretta et al. | 400/605 |
| 6,227,533 | B1 * | 5/2001 | Jang | 271/109 |
| 6,315,280 | B1 * | 11/2001 | Jang | 271/9.02 |
| 6,469,811 | B1 | 10/2002 | Tamura | |
| 6,547,234 | B1 * | 4/2003 | Quesnel | 271/9.08 |
| 6,659,443 | B1 * | 12/2003 | Eskey | 271/9.08 |
| 6,659,444 | B2 | 12/2003 | Kawarama | |
| 6,776,405 | B2 * | 8/2004 | Eskey | 271/9.08 |
| 7,140,795 | B2 * | 11/2006 | Shiraishi et al. | 400/624 |
| 7,177,962 | B2 * | 2/2007 | Seto | 710/38 |
| 7,290,762 | B2 | 11/2007 | Connors et al. | |
| 7,434,800 | B2 | 10/2008 | Asada et al. | |
| 2004/0130089 | A1 | 7/2004 | Suzuki et al. | |
| 2004/0207145 | A1 * | 10/2004 | Chang | 271/117 |
| 2006/0163796 | A1 | 7/2006 | Shiohara et al. | |

FOREIGN PATENT DOCUMENTS

| | | | |
|---|---|---|---|
| JP | S61-188337 | A | 8/1986 |
| JP | S61-277525 | A | 12/1986 |
| JP | H04-169424 | A | 6/1992 |
| JP | H08-208051 | A | 8/1996 |
| JP | 2000-128367 | A | 5/2000 |
| JP | 2001-088947 | A | 4/2001 |
| JP | 2001-301994 | A | 10/2001 |
| JP | 2005-247550 | A | 9/2005 |

OTHER PUBLICATIONS

U.S. Patent and Trademark Office, Office Action (in counterpart patent application (U.S. Appl. No. 11/536,824) to the above-captioned U.S. patent application), notification date May 15, 2008.

* cited by examiner

SHEET FEEDER INCLUDING A PLURALITY OF PAPER CASSETTES

CROSS REFERENCE TO RELATED APPLICATION

This application claims priority from Japanese Patent Application No.2005-286389 filed Sep. 30, 2005. The entire content of the priority application is incorporated herein by reference.

TECHNICAL FIELD

The disclosure relates to a sheet feeder capable of feeding recording medium one sheet at a time selectively from a first sheet-feeding cassette and a second sheet-feeding cassette disposed on the first sheet-feeding cassette to be capable of advancing and retracting while the second sheet-feeding cassette accommodating the recording medium. The disclosure also relates to an image-forming device including such a sheet feeder

BACKGROUND

Conventional image-forming devices, such as various printers and facsimile machines, generally include a sheet-feeding cassette accommodating a stack of sheets of paper or other recording medium, and the paper is fed to a recording unit one sheet at a time to be formed with images thereon. In order to form images on different types of sheets, a plurality of sheet-feeding cassettes for respective types of sheets may be attached to a main body of the image-forming device.

For example, in Japanese Patent-Application Publication No. HEI-11-599925, a flat plate-shaped second sheet-feeding cassette can be detachably disposed on a substantially box-shaped first sheet-feeding cassette so as to accommodate smaller sheets than those in the first sheet-feeding cassette therein. In this configuration, larger sheets can be accommodated in the first sheet-feeding cassette, and smaller sheets can be accommodated in the second sheet-feeding cassette. Only the first sheet-feeding cassette is attached to a main body of the image-forming device when the sheets in the first sheet-feeding cassette are to be used, and the first sheet-feeding cassette is attached to the main body of the image-forming device while the second sheet-feeding cassette is mounted on a sheet mounting surface of the first sheet-feeding cassette when the sheets in the second sheet-feeding cassette are to be used.

However, in this configuration, since the second sheet-feeding cassette is mounted on the sheet mounting surface of the first sheet-feeding cassette, the second sheet-feeding cassette must be detached each time the first sheet-feeding cassette is used after the second sheet-feeding cassette was used, and the second sheet-feeding cassette must be mounted each time the second sheet-feeding cassette is used after the first sheet-feeding cassette was used. In other words, the sheets in the first sheet-feeding cassette cannot be fed in the state where the second sheet-feeding cassette is mounted on the first sheet-feeding cassette. For example, a user may wish to perform trial print for confirming the position of an image and the state of color by forming the image on ordinary paper stored in the first sheet-feeding cassette prior to formally forming the image on a postcard accommodated in the second sheet-feeding cassette. In this case, the user needs to detach the second sheet-feeding cassette from the first sheet-feeding cassette for the trial print. Thus, although the two sheet-feeding cassettes can be attached to the main body of the image-forming device, the sheet (sheet-feeding cassette) to be used needs to be replaced each time. The procedure to form images therefore becomes complicated.

Also, it is necessary to detach the second sheet-feeding cassette and to place the same at a separate position if only the first sheet-feeding cassette is used for a long time. Thus, a storage place is needed for the second sheet-feeding cassette, and there is a danger that the detached second sheet-feeding cassette is lost. Furthermore, since the second sheet-feeding cassette is detachably mounted on the first sheet-feeding cassette, an operation of correctly positioning the second sheet-feeding cassette on the first sheet-feeding cassette is complicated.

A first sheet-feeding cassette and a second sheet-feeding cassette disclosed in Japanese Patent-Application Publication No. HEI-11-314773 are stacked one on the other with a partition wall interposed therebetween, and are attached to a main body of an image-forming device. The first and second sheet-feeding cassettes are both shaped like a box and have the same configuration. Only sheets in an upper one of the first and second sheet-feeding cassettes contact a sheet feeding roller. In this configuration, the first and second sheet-feeding cassettes are attached to the main body such that the first sheet-feeding cassette is disposed on top of the second sheet-feeding cassette when sheets in the first sheet-feeding cassette are used, and the second sheet-feeding cassette is disposed on top of the first sheet-feeding cassette when sheets in the second feeding cassette are used. These stacked sheet-feeding cassettes are coupled to each other with a hinge having a center shaft on one side of a stack surface. By pivoting the first or second sheet-feeding cassette about the hinge to open to the outside, sheets can be supplied to the sheet supply cassette.

With this configuration, since the first and second sheet-feeding cassettes are coupled to each other with the hinge, it is unnecessary to position the two sheet-feeding cassettes with respect to each other, and there is no danger that the sheet-feeding cassettes are lost. However, in this configuration, in order to change the sheets to be used, a user needs to first detach the two sheet-feeding cassettes stacked one on the other from the main body of the image-forming device, turn the sheet-feeding cassettes upside down to interchange the vertical positions of the sheet-feeding cassettes, and then reattach the same to the main body. That is, as in Japanese Patent-Application Publication No. HEI-11-599925 described above, the sheet-feeding cassettes need to be detached each time the sheets to be used are changed, complicating operations for forming images.

SUMMARY

In view of the foregoing, it is an object of the invention to overcome the problems and also to provide a sheet feeder and an image-forming device including the sheet feeder having a simple configuration and capable of storing and feeding recording medium of different sizes and improving convenience in switching of the recording medium to be fed and in supplying of recording medium to a sheet-feeding cassette without impairing accuracy of feeding the recording medium.

In order to attain the above and other objects, the invention provides a sheet feeder including: a first cassette having an accommodating section that is capable of accommodating a stack of first recording medium; a feed roller that feeds the first recording medium one sheet at a time in a feeding direction; and a second cassette disposed on the first cassette above the accommodating section so as to be movable with respect to the first cassette between a first position and a second position downstream of the first position with respect to the feeding direction. The second cassette has a mounting section capable of holding a stack of second recording medium having a size different from a size of the first recording medium. The feed roller contacts the second recording medium held by the second cassette when the second cassette is located at the second position. The mounting section of the second cassette has a first portion and a second portion. The second portion is displaceable relative to the first portion between a closed position and an open position, wherein the second portion exposes the accommodating section wider in the open position than in the closed position. The first portion is capable of engaging with and disengaging from the first cassette.

There is also provided an image-forming device including: a casing; a recording unit disposed within the casing for forming an image on a recording medium; a cassette detachably attachable to the casing below the recording unit; and a feed roller. The cassette includes a first cassette having an accommodating section that is capable of accommodating a stack of first recording medium, and a second cassette disposed on the first cassette above the accommodating section so as to be movable with respect to the first cassette between a first position and a second position downstream of the first position with respect to a feeding direction. The second cassette has a mounting section capable of holding a stack of second recording medium having a size different from a size of the first recording medium. The feed roller feeds the first recording medium and the second recording medium in the feeding direction toward the recording unit. The feed roller contacts the first recording medium held by the first cassette when the second cassette is located at the first position, and the feed roller contacts the second recording medium held by the second cassette when the second cassette is located at the second position. The mounting section of the second cassette has a first portion and a second portion. The second portion is displaceable relative to the first portion between a closed position and an open position, wherein the second portion exposes the accommodating section wider in the open position than in the closed position. The first portion is capable of engaging with and disengaging from the first cassette.

BRIEF DESCRIPTION OF THE DRAWINGS

Illustrative aspects in accordance with the invention will be described in detail with reference to the following figures wherein:

FIG. 5(*b*) is a side cross-sectional view of the paper supply mechanism in FIG. 4 with the second sheet-feeding cassette being positioned at a sheet non-feeding position;

FIG. 7(*b*) is a perspective view of the first sheet-feeding cassette and the second sheet-feeding cassette at the sheet non-feeding position;

FIG. 8(*b*) is a perspective view of the first sheet-feeding cassette and the second sheet-feeding cassette at the sheet non-feeding position with the first accommodating section at the open position;

FIG. 11(*b*) is a side cross-sectional view of the first sheet-feeding cassette and the second sheet-feeding cassette taken along a line XIIb-XIIb in FIG. 11(*a*).

DETAILED DESCRIPTION

Figure 1:
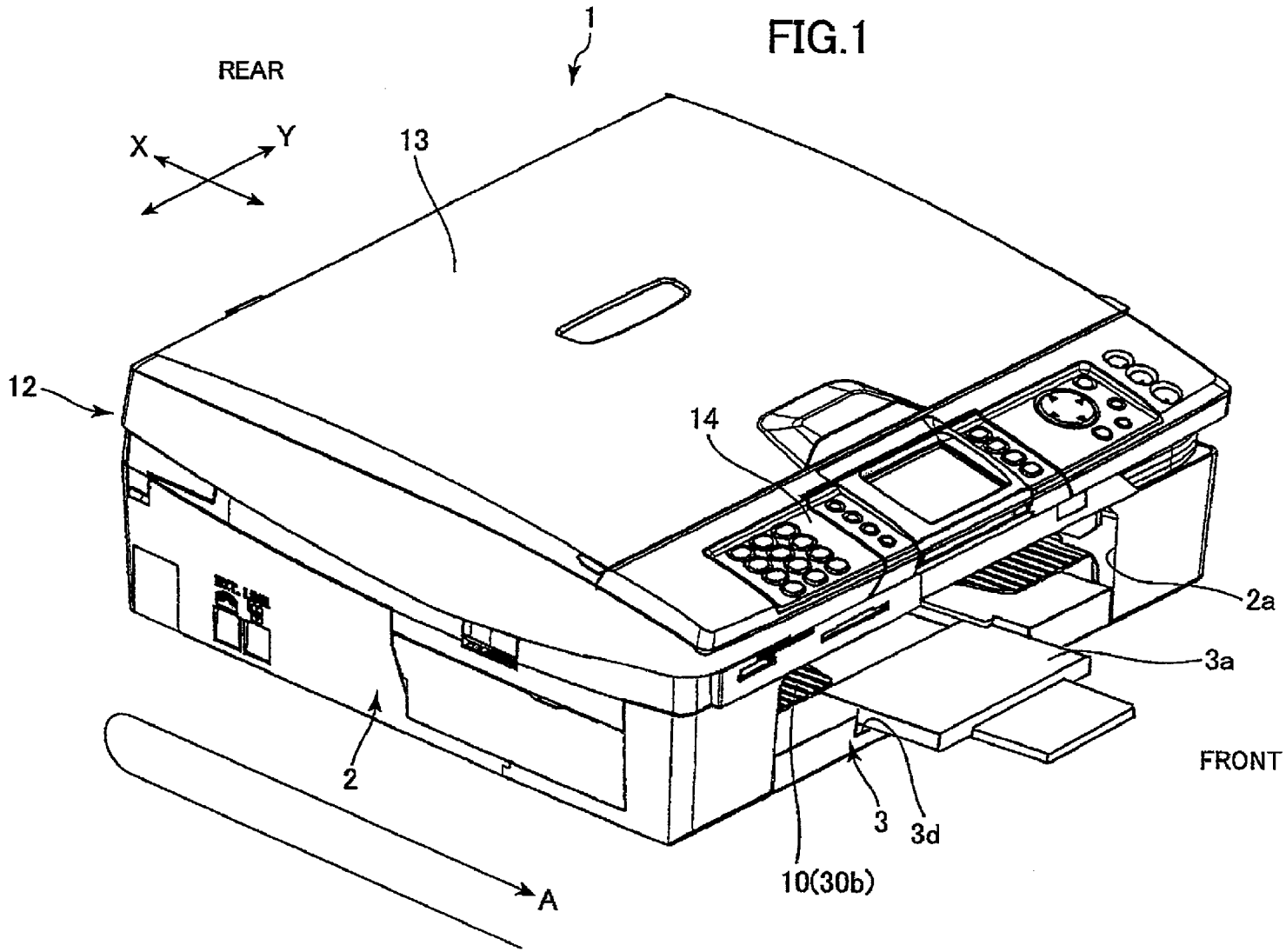
FIG. 1 is a perspective view of an image-forming device according to first illustrative aspects of the invention.

Image-forming devices according to some aspects of the invention will be described while referring to the accompanying drawings wherein like parts and components are designated by the same reference numerals to avoid duplicating description.

First, an image-forming device 1 according to first illustrative aspects of the invention will be described with reference to FIGS. 1 to 8.

Figure 2:
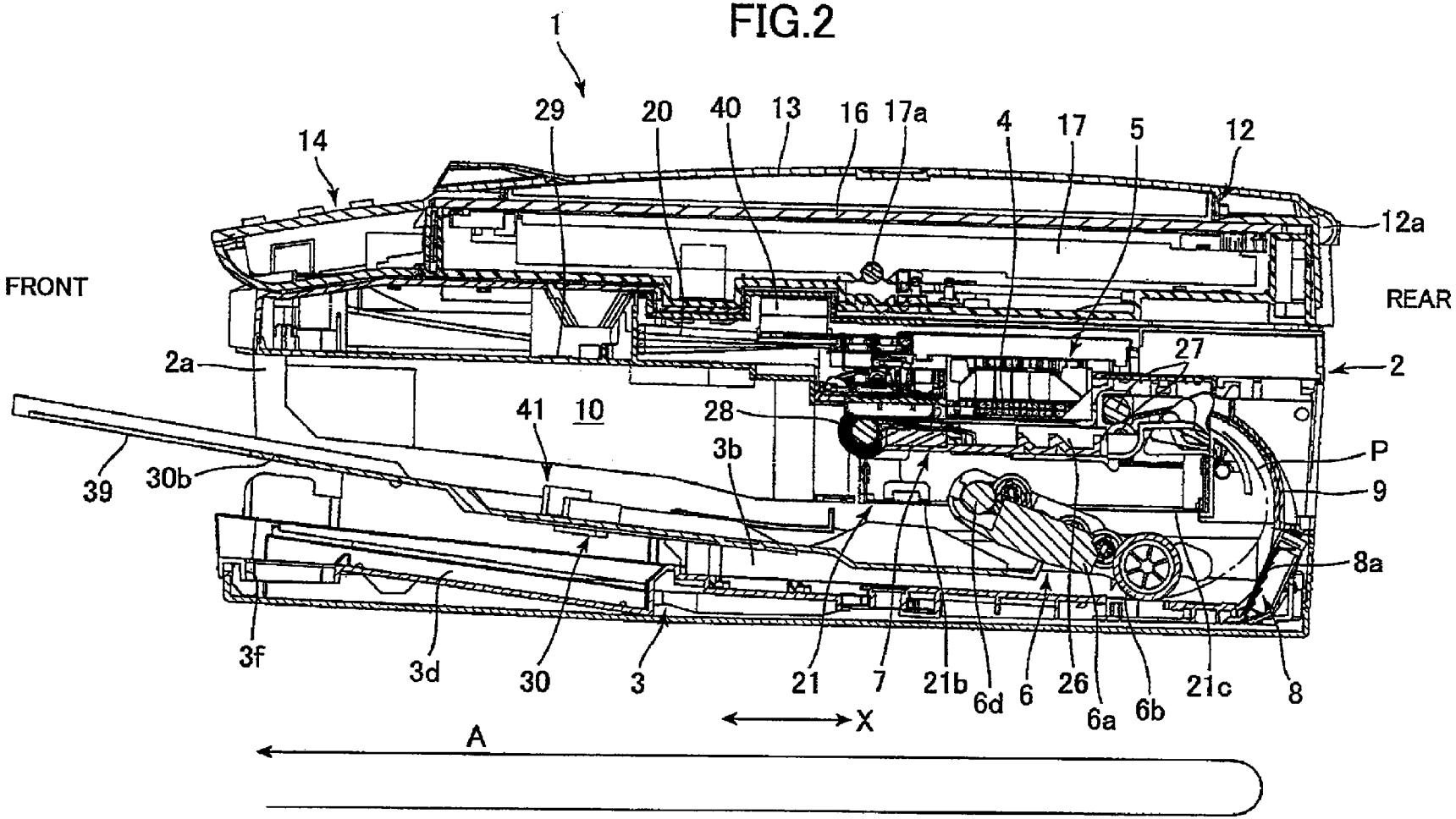
FIG. 2 is a side cross-sectional view of the image-forming device in FIG. 1.

The image-forming device 1, to which the invention is applied, is a multifunction device (MFD) having a printing function, a copying function, a scanning function, and a facsimile function. As shown in FIGS. 1 and 2, the image-forming device 1 includes a housing 2 made from a synthetic resin injection-molded piece. A first sheet-feeding cassette 3 that accommodates a stack of sheets of paper P is disposed in the bottom section of the housing 2. The first sheet-feeding cassette 3 can be pulled out of the housing 2 through a discharge opening 2*a* formed in a side of the housing 2. Note that in the following description, a side on which the discharge opening 2*a* is provided is referred to as a front side of the image-forming device 1, and a side furthest from the discharge opening 2*a* is referred to as a rear side of the image-forming device 1.

A second sheet-feeding cassette 30 is disposed on the top of the first sheet-feeding cassette 3 so as to be capable of advancing and retracting in a front-to-rear direction X.

An image reader 12 for reading images on an original in copying and facsimile functions is disposed on top of the housing 2. The image reader 12 is pivotable upward and downward about a shaft (not shown) disposed at a widthwise end of the housing 2. The top surface of the image reader 12 is covered by a document cover 13. A rear edge of the document cover 13 is attached to the rear edge of the image reader 12 by hinges 12*a* (FIG. 2) so that the document cover 13 can pivot upward and downward about the hinges 12*a*.

An operation panel 14 is disposed on the top of the housing 2 frontward of the image reader 12. The operation panel 14 includes various operation buttons, a liquid crystal display, and the like. As shown in FIG. 2, a glass plate 16 is disposed on the top surface of the image reader 12. An original can be mounted on the glass plate 16 by pivoting the document cover 13 upward. A contact image sensor (CIS) 17 is disposed beneath the glass plate 16 for reading images on originals so as to be reciprocatingly movable along a guide shaft 17*a* extending in a widthwise direction Y (FIG. 1) perpendicular to the sheet surface of FIG. 2.

Figure 3:
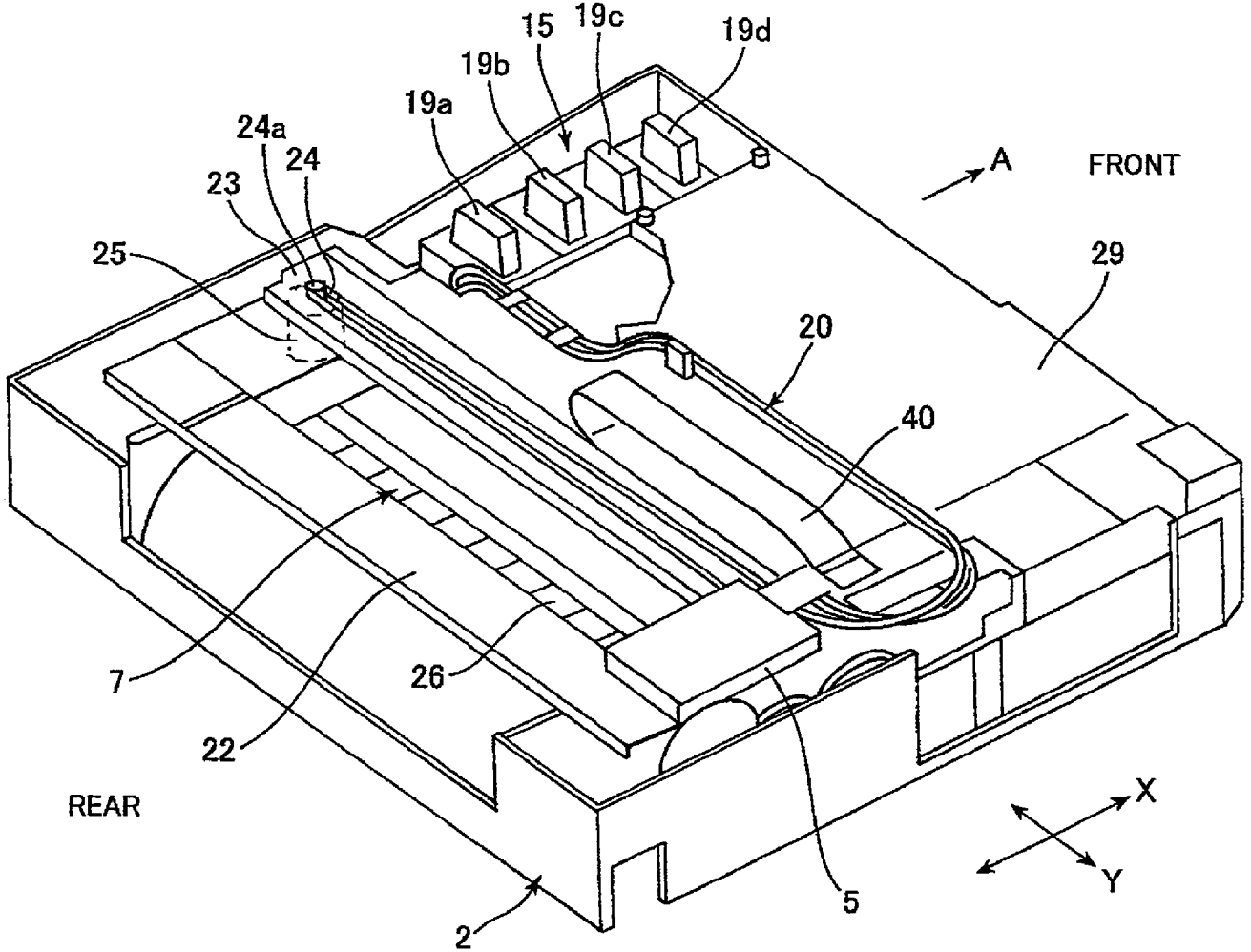
FIG. 3 is a perspective view showing the internal structure of the image-forming device in FIG. 1.

The image-forming device 1 further includes a recoding unit 7 and a discharge tray 10 shown in FIG. 2 and an ink storage section 15 shown in FIG. 3 which is disposed on one side of the discharge tray 10. The recoding unit 7, the discharge tray 10, and the ink storage section 15 are disposed within an area projected by the image reader 12 and the operation panel 14 in a plan view.

As shown in FIG. 2, the sheet of paper P are conveyed one sheet at a time within the housing 2 along a paper conveying direction A. More specifically, the sheet of paper P is first conveyed within the housing 2 from the front toward the rear, reversed by a U-turn path 9 located at a rear end of the housing 2 to be conveyed frontward, and then discharged through the discharge opening 2*a*.

A main frame 21 in an open-top box-shape is disposed within the housing 2. Plate-shaped first and second guide members 22 and 23 shown in FIG. 3 are supported on a pair of left and right plates (not shown) of the main frame 21 so as to extend in the widthwise direction Y. The second guide member 23 is disposed on the downstream side of the first guide member 22 in the paper conveying direction A.

The recoding unit 7 includes a recording head 4 (FIG. 2) and a carriage 5. The recording head 4 is an inkjet-type recording head and is mounted on the carriage 5. Although not shown in the drawings, the recording head 4 has a nozzle surface facing downward. The nozzle surface is formed with nozzles through which ink droplets are ejected. The carriage 5 mounting the recording head 4 is slideably supported on the first and second guide plates 22 and 23 so as to be reciprocally movable in a main scanning direction (widthwise direction) Y.

A timing belt 24 for reciprocatingly moving the carriage 5 is disposed on the top surface of the second guide member 23 so as to extend in the main scanning direction Y, and is wound around a pulley 24*a*. A carriage motor 25 is fixed on the bottom surface of the second guide member 23 for driving the timing belt 24. According to the first illustrative aspects, a DC motor is used as the carriage motor 25, but a stepping motor or other types of motors may be used instead. An endless encoder strip (not shown) is disposed on the second guide member 23 for detecting a position of the carriage 5 in the main scanning direction Y. The encoder strip extends in the main scanning direction Y and has a vertically-extending detection surface in which slits are formed at fixed intervals in the main scanning direction Y.

As shown in FIG. 2, a platen 26 is fixed at a position above a bottom plate 21*b* of the main frame 21 and between the first and second guide members 22 and 23 shown in FIG. 3. The platen 26 has a flat shape extending in the main scanning direction Y and opposes the nozzle surface of the recording head 4.

As shown in FIGS. 2 and 3, a partitioning plate 29 made of compound resin is integrally formed with the housing 2. The partitioning plate 29 is positioned above the discharge tray 10 and extends from the bottom surface of the second guide member 23 to the discharge opening 2*a* at the front side of the housing 2. The partitioning plate 29 has substantially the same height as the bottom plate 21*b* of the main frame 21.

As shown in FIG. 3, the ink storage section 15 accommodates ink cartridges 19 (19*a* through 19*d*) for color printing in an alignment in the front-to-rear direction X. The ink storage section 15 is open on the top so that the ink cartridges 19 can be mounted on and dismounted from the ink storage section 15 from the open top side. Each ink cartridge 19 stores ink of one of four colors black (Bk), cyan (C), magenta (M) and yellow (Y). Each of the ink cartridges 19 has a substantially rectangular box-shape with a small cross-sectional area in a plan view and a high height.

The ink stored in the ink cartridges 19 is supplied to the recording head 4 via four supply tubes 20. It should be noted that if ink of more than four colors (e.g., six, seven, or eight colors) is used for the color printing, then the numbers of the ink cartridges 19 and the ink supply tubes 20 may be increased in proportion to the number of ink colors.

As shown in FIG. 3, the ink supply tubes 20 are bundled near an end of the ink storage section 15 and extend along the surface of the partitioning plate 29 in the widthwise direction Y from the left side to the right side thereof. The bundled sections of the ink supply tubes 20 are aligned in a horizontal direction along the horizontal flat top surface of the partitioning plate 29. At least a portion (middle section, for example) of the ink supply tubes 20 is supported on the upper surface of the partitioning plate 29.

Although not shown in the drawings, the recoding unit 7 includes an ink receiving portion and a maintenance unit disposed one on either side of the paper conveying path, that is, outside the width of the sheet of paper P to be conveyed. During printing operation, the recording head 4 regularly performs a flushing operation for ejecting ink in order to prevent the nozzles from being clogged, at a flushing position opposing the ink receiving portion. Ink ejected through the flushing operation is received at the ink receiving portion. The maintenance unit selectively draws ink of each color while a cap is covering over the nozzle surface of the recording head 4 from below when the carriage 5 is at a standby position. The maintenance unit also performs a recovering operation for removing air bubbles contained in a buffer tank (not shown) of the recording head 4. Further, a cleaning operation is performed for wiping the nozzle surface of the recording head 4 by a cleaner (wiper blade) as the carriage 5 moves in the widthwise direction Y toward the maintenance unit.

As shown in FIG. 3, a flexible flat cable 40 connects a controller (not shown) disposed on the housing 2 to the recording head 4 for transmitting various instruction signals from the controller to the recording head 4. In response to the instruction signals, ink droplets are selectively ejected from the recording head 4 through the nozzles. The flexible flat cable 40 is disposed in an area where unbundled and unrestrained sections of the ink supply tubes 20 move in accordance with the reciprocal movement of the carriage 5 in the main scanning direction Y, and extends substantially in parallel with the ink supply tubes 20.

A protruding direction of intermediate curved portion of the ink supply tubes 20 is set to be opposite to a protruding direction of an intermediate curved portion of the flexible flat cable 40 with respect to a reciprocating direction of the carriage 5. With this configuration, the ink supply tubes 20 and the flexible flat cable 40 can be arranged at the substantially same height in the vertical direction (on the substantially same horizontal plane), thereby making the entire image-forming device 1 thinner.

As shown in FIG. 2, a pair of registration rollers 27 is disposed on the upstream side of the platen 26 in the paper conveying direction A for conveying the sheet of paper P to a position below the recording head 4. A discharge roller 28 is disposed on the downstream side of the platen 26 in the paper conveying direction A for discharging the sheet of paper P onto the discharge tray 10 after images have been formed on the paper P.

The image-forming device 1 further includes a paper supplying mechanism for supplying sheets of paper P. The paper supplying mechanism includes a sheet supply unit 6, the first sheet-feeding cassette 3, and the second sheet-feeding cassette 30.

Figure 4:
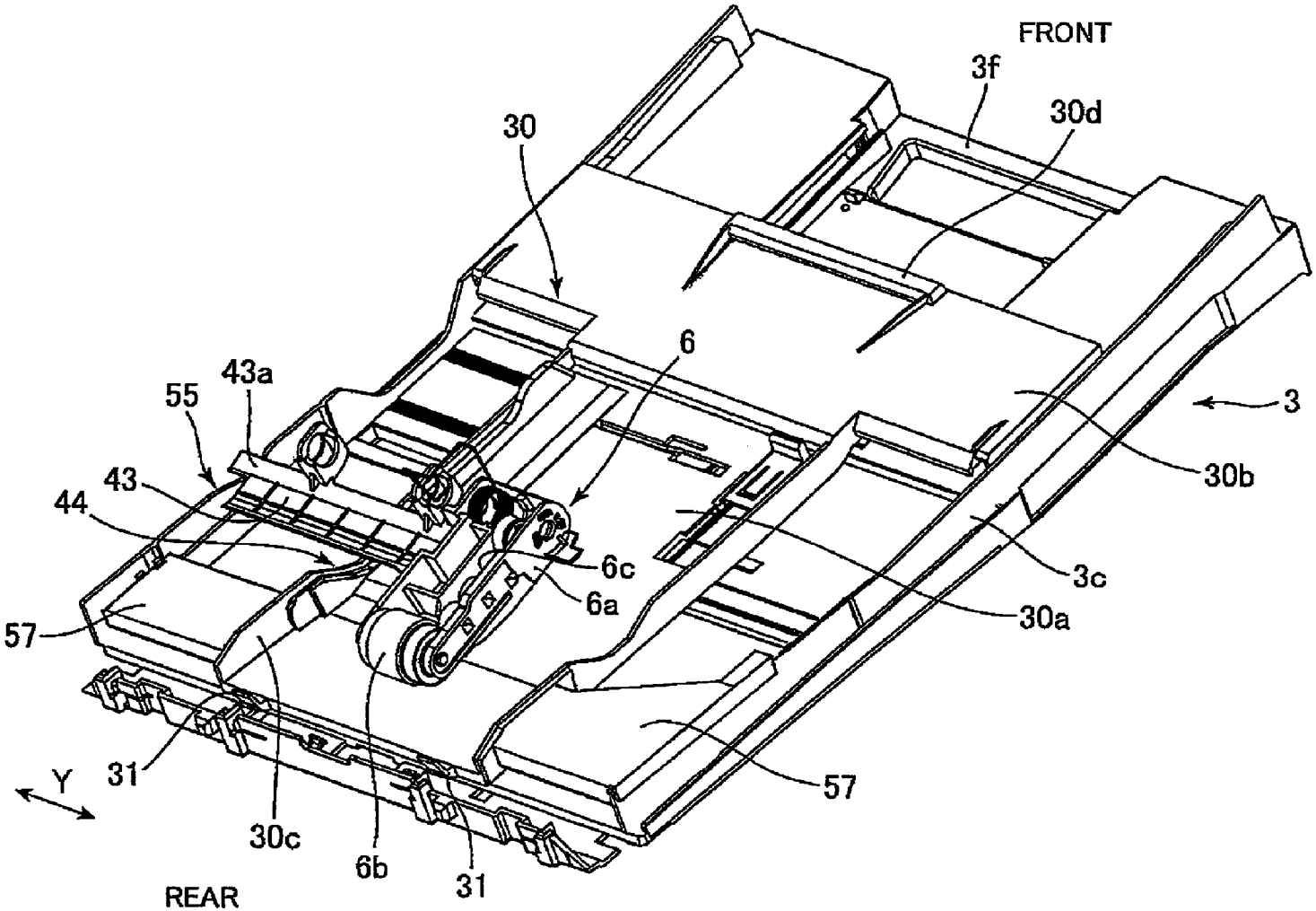
FIG. 4 is a perspective view of a paper supply mechanism of the image-forming device in FIG. 1.
Figure 5A:
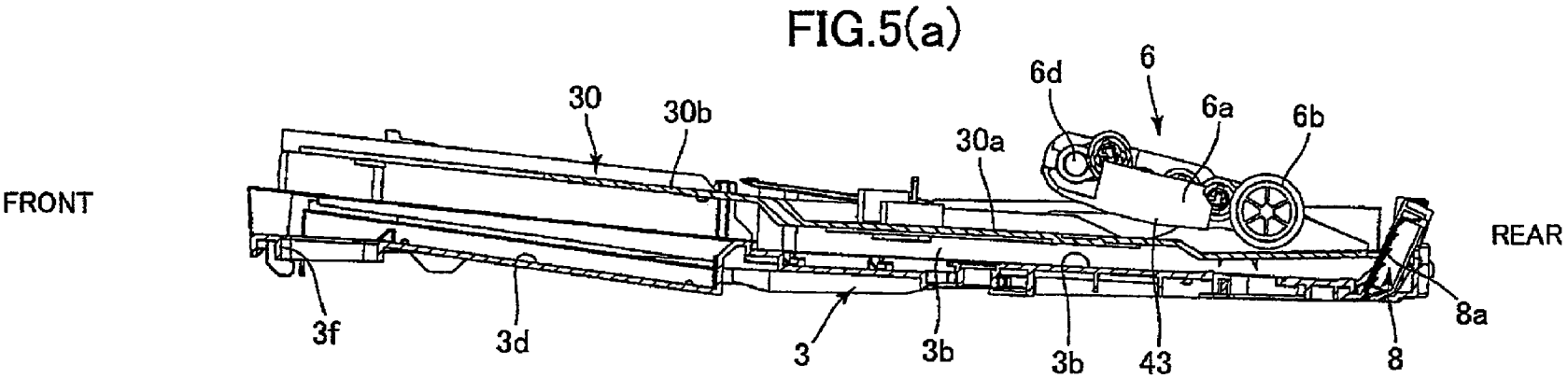
FIG. 5(*a*) is a cross-sectional view of the paper supply mechanism in FIG. 4 with a second sheet-feeding cassette being positioned at a sheet feeding position.
Figure 5B:
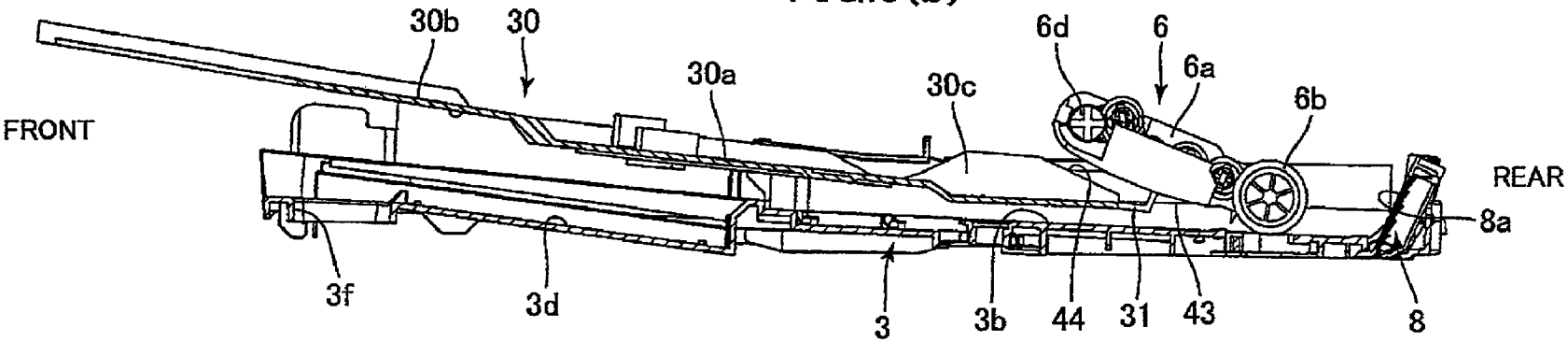

As shown in FIGS. 4 and 5(*a*), the sheet supply unit 6 includes a sheet supply arm 6*a*, a sheet supply roller 6*b*, a gear mechanism 6*c*, a drive shaft 6*d*, and a cam follower member 43. The sheet supply arm 6*a* is pivotable upward and downward about the front end thereof. The sheet supply roller 6*b* is rotatably supported at the rear end of the sheet supply arm 6*a*. Although not shown in the drawings, the drive shaft 6*d* is rotatably supported on the side plates of the main frame 21 and a pair of shaft support plates by being inserted into bearings formed therein. Tip ends of the drive shaft 6*d* are inserted through the front section of the sheet supply arm 6*a* so as to protrude from the sheet supply arm 6*a* in the widthwise direction Y. The gear mechanism 6*c* is disposed inside the sheet supply arm 6*a*. Driving force generated by rotation of the drive shaft 6*d* is transmitted to the sheet supply roller 6*b* via the gear mechanism 6*c*, thereby rotating the sheet supply roller 6*b* in one direction, which is a counterclockwise direction in FIG. 2 and a clockwise direction in FIG. 4. An urging member (not shown), such as a torsion spring, constantly biases the rear end of the sheet supply arm 6*a* downward.

The first sheet-feeding cassette 3 and the second sheet-feeding cassette 30 can be inserted or removed through the discharge opening 2*a* of the housing 2 as a unit. As shown in FIG. 5(*a*), the first sheet-feeding cassette 3 has an accommodating section 3*b* capable of accommodating a stack of a large number of sheets of paper P. The second sheet-feeding cassette 30 is disposed on the accommodating section 3*b* of the first sheet-feeding cassette 3 so as to be capable of advancing and retracting with respect to the first sheet-feeding cassette 3 between a sheet feeding position shown in FIG. 5(*a*) and a sheet non-feeding position shown in FIG. 5(*b*). The second sheet-feeding cassette 30 serves to accommodate a stack of sheets of paper P1 (FIG. 6) which are smaller than the sheets of paper P in the first sheet-feeding cassette 3.

The accommodating section 3*b* of the first sheet-feeding cassette 3 accommodates a stack of sheets of paper P of a large size, such as A4 size, letter size, or legal size, such that short sides of the paper P extend in the main scanning direction Y. A maximum number of the sheets of paper P that can be accommodated in the accommodating section 3*b* is about 100 with approximately 10 mm in height in the case of standard paper. As shown in FIG. 5(*a*), a depressed portion 3*d* is formed in the accommodating section 3*b* at the front section thereof. An auxiliary support member 3*a* shown in FIG. 1 is provided so as to be movable in the front-to-rear direction (sub-scanning direction) X. The auxiliary support member 3*a* is for supporting a trailing portion of long sheets of paper P of legal size or the like. The auxiliary support member 3*a* can be pulled out to the front of the housing 2 as shown in FIG. 1. By moving the auxiliary support member 3*a* toward the rear, the auxiliary support member 3*a* is accommodated in the depressed portion 3*d*.

When the auxiliary supporting member 3*a* is accommodated in the depressed portion 3*d*, the length of the first sheet-feeding cassette 3 in the front-to-rear direction X is almost the same as the sum of the lengths of the image reader 12 and the operation panel 14 in the front-to-rear direction X. Thus, since the image-forming device 1 is a rectangular parallelepiped having a substantially square plane in a plan view, packing is facilitated at the time of shipping, and a box for packing can be made compact.

Figure 7A:
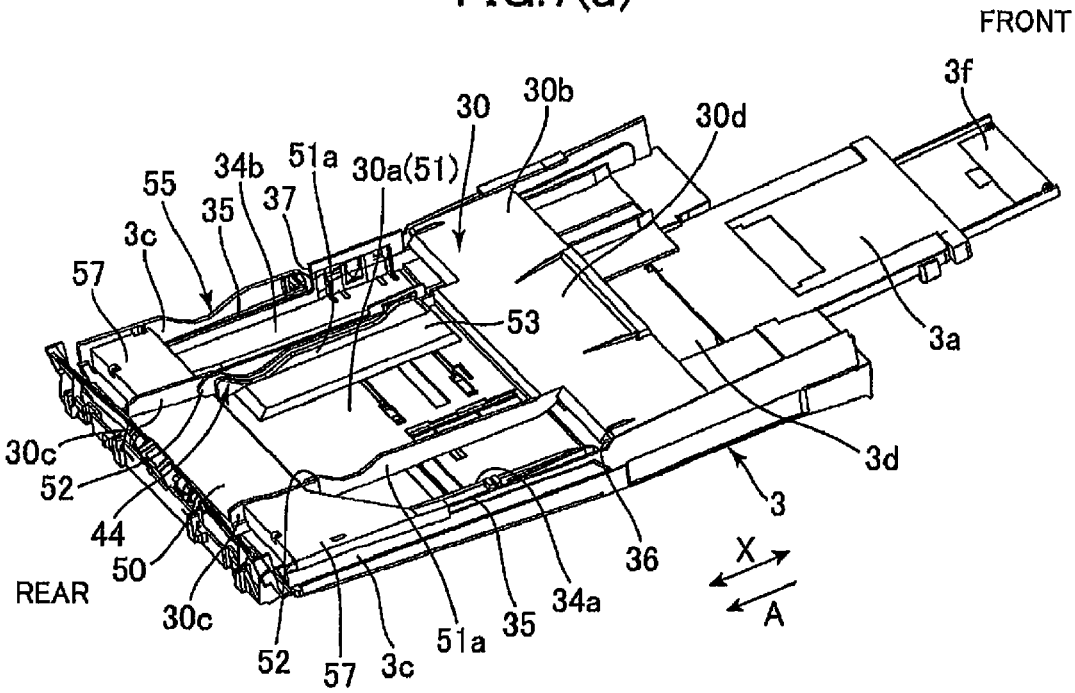
FIG. 7(*a*) is a perspective view of the first sheet-feeding cassette and the second sheet-feeding cassette at the sheet feeding position.
Figure 7B:
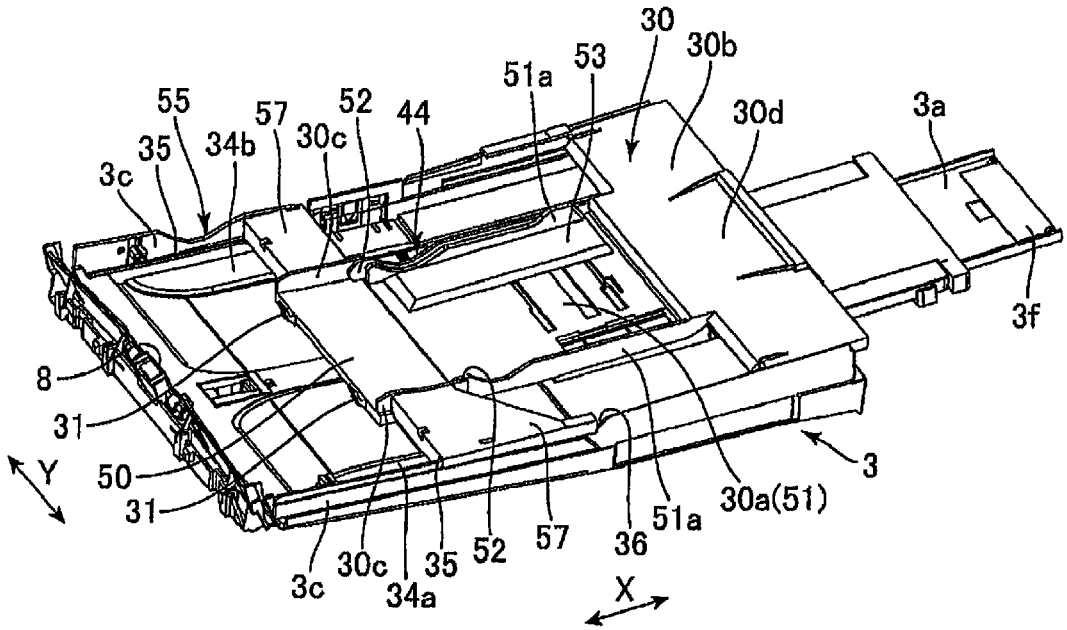

As shown in FIG. 7(*a*), a handle 3*f* is formed at a front end of the auxiliary supporting member 3*a* so that an operator is easy to put his/her fingers thereon when inserting or removing the first and second sheet-feeding cassettes 3 and 30 into or from the discharge opening 2*a* of the housing 2.

A pair of left and right side guide members 34*a* and 34*b* is provided in the accommodating section 3*b* for guiding side edges of the paper P parallel to the paper conveying direction A and for positioning the paper P. The side guide members 34*a* and 34*b* are movable (slidable) in the main scanning direction Y so that the distance therebetween becomes smaller or larger. A rack member (not shown) is connected to the bottoms of the side guide members 34*a* and 34*b*, and engages with a gear (not shown) disposed along a center line in the width direction Y of a bottom plate of the first sheet-feeding cassette 3, such that a center line of the first sheet-feeding cassette 3 in the main scanning direction Y is aligned with a center line of the paper P in the width direction Y.

As shown in FIG. 2, a main inclined separating plate 8 is detachably provided at a rear end of the first sheet-feeding cassette 3. A serrated elastic separating pad 8*a* formed of a metal leaf spring is provided at the center in the width direction Y of an inner side surface of the main inclined separating plate 8, The sheet supply roller 6*b* of the sheet supply unit 6 and the elastic separating pad 8*a* together separate and convey the paper P or P1 on the first or second sheet-feeding cassette 3 or 30 one sheet at a time. The separated paper P, P1 is fed to the recording unit 7 provided above the sheet-feeding cassettes 3 and 30 via the U-turn path 9. Then, the paper P, P1 formed with images at the recording unit 7 is discharged to the discharge tray 10 connected to the discharge opening 2*a* with a recorded surface facing upward.

As shown in FIG. 7(*b*), the inner side surface of the main inclined separating plate 8 is a convex surface that warps rearward toward both ends from a central part in the width direction Y such that the central part locates at the foremost position. Thus, the leading end of the fed paper P or P1 comes into sliding contact with the elastic separating pad 8*a* at a central section in the width direction Y before sections at both ends come into contact with the surface of the main inclined separating plate 8. Accordingly, the sheets of paper P, P1 can be certainly separated one at a time. Although not shown in the drawings, freely-rotatable columns are disposed on right and left sides of the elastic separating pad 8*a* and in the vicinity of an upper end of the main inclined separating plate 8 for smoothly guiding the paper P, P1 toward the U-turn path 9.

The second sheet-feeding cassette 30 has a accommodating section 30*a* and left and right side plates 30*c*. The accommodating section 30*a* is for accommodating the sheets of paper P1. The side plates 30*c* extend in the paper conveying direction A.

The accommodating section 30*a* is capable of accommodating a stack of sheets of paper P1 (FIG. 6) smaller than the paper P accommodated in the first sheet-feeding cassette 3. The paper P may be postcards, L-sized photo paper, or the like. The paper P1 differs from the paper P in size, but may also differ in type. For example, the paper P1 may be inkjet-printer-ready paper, gloss photo paper, or the like.

The accommodating section 30*a* is formed narrower than the first sheet-feeding cassette 3 in the width direction Y and disposed at the center of the first sheet-feeding cassette 3 in the width direction Y. Thus, upper surfaces of the side guide members 34*a* and 34*b* of the first feeding cassette 3 are exposed without completely being covered with the second sheet-feeding cassette 30. Accordingly, the operator can easily reach the side guide members 34*a* and 34*b* of the first sheet-feeding cassette 3 without removing the second sheet-feeding cassette 30, so that the paper P in the first sheet-feeding cassette 3 can be positioned easily.

The accommodating section 30*a* has a first accommodating section 50 which is not displaced when paper P is supplied to the first sheet-feeding cassette 3 and a second accommodating section 51 which is displaced relative to the first accommodating section 50 when the paper P are supplied to the first sheet-feeding cassette 3. The first accommodating section 50 is disposed at a downstream section of the accommodating section 30*a* in the paper conveying direction A and formed integrally with the left and right side plates 30*c*. Hinges 52 having respective shafts (not shown) extending in the width direction Y are disposed at the upstream ends of the side plates 30*c* in the paper conveying direction A, such that the hinges 52 are located upstream of the first accommodating section 50 with respect to the paper conveying direction A. The second accommodating section 51 is pivotably attached to the first accommodating section 50 via the hinges 52.

Figure 8A:
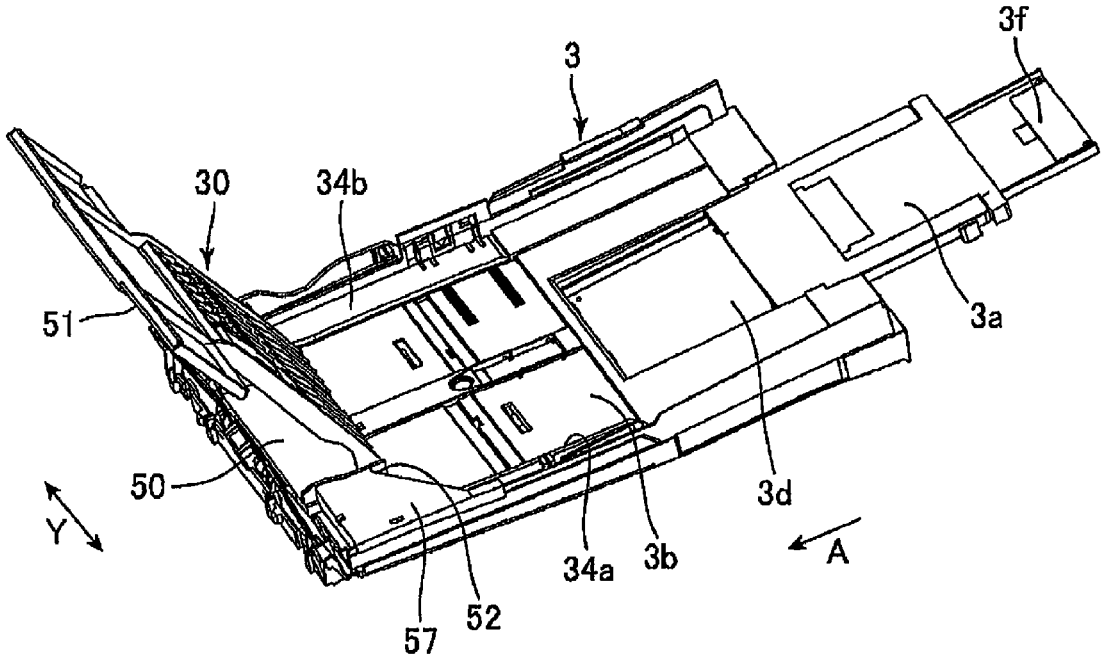
FIG. 8(*a*) is a perspective view of the first sheet-feeding cassette and the second sheet-feeding cassette at the sheet feeding position with a first accommodating section at an open position.
Figure 8B:
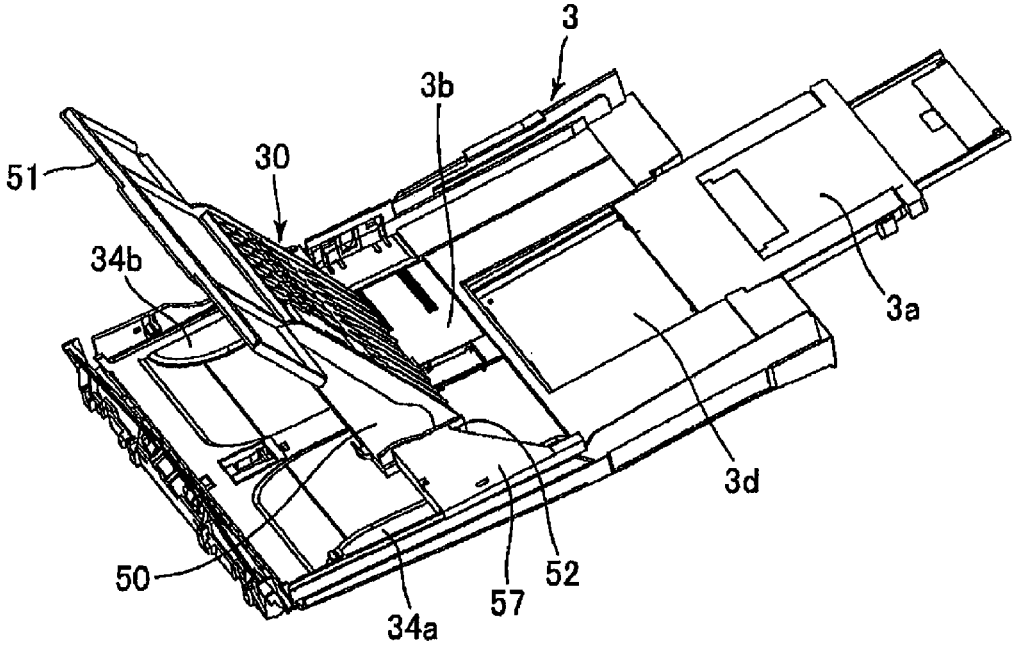

Specifically, the second accommodating section 51 is displaceable about the hinges 52 between a closed position (FIG. 7(*a*), FIG. 7(*b*)) to cover the accommodating section 3*b* of the first sheet-feeding cassette 3 from above and an open position (FIG. 8(*a*), FIG. 8(*b*)) to open at least a part of the accommodating section 3*b*. In other words, the second accommodating section 51 exposes the accommodating section 3*b* wider when in the open position than in the closed position.

In order to supply paper P to the first sheet-feeding cassette 3, the first sheet-feeding cassette 3 together with the second sheet-feeding cassette 30 are removed from the housing 2. At this time, the second sheet-feeding cassette 30 is located at either the sheet feeding position (FIG. 7(*a*)) or the sheet non-feeding position (FIG. 7(*b*)). In either case, the second accommodating section 51 can pivot such that an upstream end of the second accommodating section 51 in the paper conveying direction A moves upward (FIG. 8(*a*) and FIG. 8(*b*)) The accommodating section 3*b* of the first sheet-feeding cassette 3 is opened widely on the top by pivoting the second accommodating section 51 in this manner, facilitating the supplying of paper P to the first sheet-feeding cassette 3. Especially, since the second accommodating section 51 pivots such that the upper surface of the accommodating section 3*b* is opened wider at the upstream side than at the downstream side in the paper conveying direction A, the operation of inserting the paper P from the upstream side in the paper conveying direction A is extremely easy.

Furthermore, the hinges 52 are provided in the middle of the accommodating section 30*a* in the paper conveying direction A, and the length of the second accommodating section 51 in the paper conveying direction A is set shorter than the length of the entire accommodating section 30*a*. Thus, in comparison with the case where the entire accommodating section 30*a* is formed as a first accommodating section (where the hinges 52 are disposed at the downstream end of the accommodating section 30*a* in the paper conveying direction A), when the second accommodating section 51 is pivoted upward, a pivotal angle is larger, and thus the accommodating section 3*b* is opened wider. This further facilitates the operation of supplying paper P to the accommodating section 3*b*.

Note that the paper P1 is supported on the first accommodating section 50 and the second accommodating section 51 of the accommodating section 30*a* when the second accommodating section 51 is at the closed position shown in FIG. 7(*a*). However, when the second accommodating section 51 is moved to the open position shown in FIG. 8(*a*), the paper P is supported and lifted upward by the second accommodating section 51 and thus separated from the first accommodating section 50.

As shown in FIG. 7(*a*), left and right guide plates 51*a*, 5*a* and a guiding member 53 are disposed to the second accommodating section 51 for guiding the sheets of paper P2 mounted on the accommodating section 30*a* so that the paper P2 are aligned parallel to the paper conveying direction A.

The side plates 30*c* are integrally formed with respective wings 57, each protruding toward the side plate 3*c* of the first sheet-feeding cassetdote 3. The wings 57 are formed so as to slide along rails 35 provided at the side plates 3*c*. With this configuration, while being guided by the rails 35, the entire second sheet-feeding cassette 30 is capable of advancing or retracting with respect to the first sheet-feeding cassette 3 between the sheet feeding position shown in FIG. 7(*a*) and the sheet non-feeding position shown in FIG. 7(*b*) as described above. When the second sheet-feeding cassette 30 is located at the sheet feeding position, the paper P1 in the second sheet-feeding cassette 30 is used for printing, and when the second sheet-feeding cassette 30 is located at the sheet non-feeding position, the paper P in the first sheet-feeding cassette 3 is used for printing.

Although not shown in the drawings, the wings 57 are provided with retaining members that prevents the wings 57 from slipping out of the rails 35. In this manner, the second sheet-feeding cassette 30 is prevented from slipping out of the first sheet-feeding cassette 3.

A discharged-sheet receiving section 30*b* having the same width as that of the first sheet-feeding cassette 30 is integrally formed with the second accommodating section 51 so as to be continuous with the upstream end of the second accommodating section 51 in the paper conveying direction A. When images are formed on large-sized paper P supplied from the first sheet-feeding cassette 3 while the second sheet-feeding cassette 30 is at the sheet non-feeding position, the discharged-sheet receiving section 30*b* reliably receives the paper P discharged out of the housing 2 without the paper P running off the edge. This eliminates the need to separately provide a discharged-paper receiving member, thereby making overall configuration of the image-forming device simple and compact.

A handle 30*d* is provided at an end of the discharged-sheet receiving section 30*b* so that the operator is easy to grasp the discharged-sheet receiving section 30*b*. Grabbing the handle 30*d*, the operator can slide the second sheet-feeding cassette 30 between the sheet feeding position and the sheet non-feeding position. A stopper 37 is formed at an upstream end of one of the rails 35 in the paper conveying direction A to be higher than the rails 35 for preventing the second sheet-feeding cassette 30 from retracting further from the sheet non-feeding position to get out of the first sheet-feeding cassette 3 and for notifying the operator that the second sheet-feeding cassette 30 has reached the sheet non-feeding position. Thus, the second sheet-feeding cassette 30 is prevented from slipping out of the first sheet-feeding cassette 3.

As described above, the second sheet-feeding cassette 30 is configured to slidingly advance or retract with respect to the first sheet.-feeding cassette 3, but is not removed from the first sheet-feeding cassette 3. Thus, the second sheet-feeding cassette 30 can be easily positioned at a proper position relative to the first sheet-feeding cassette 3. Furthermore, since the second sheet-feeding cassette 30 is constantly attached to the first sheet-feeding cassette 3, a separate storage place for the unused second sheet-feeding cassette 30 is unnecessary, and there is no danger of losing the second sheet-feeding cassette 30.

Figure 6:
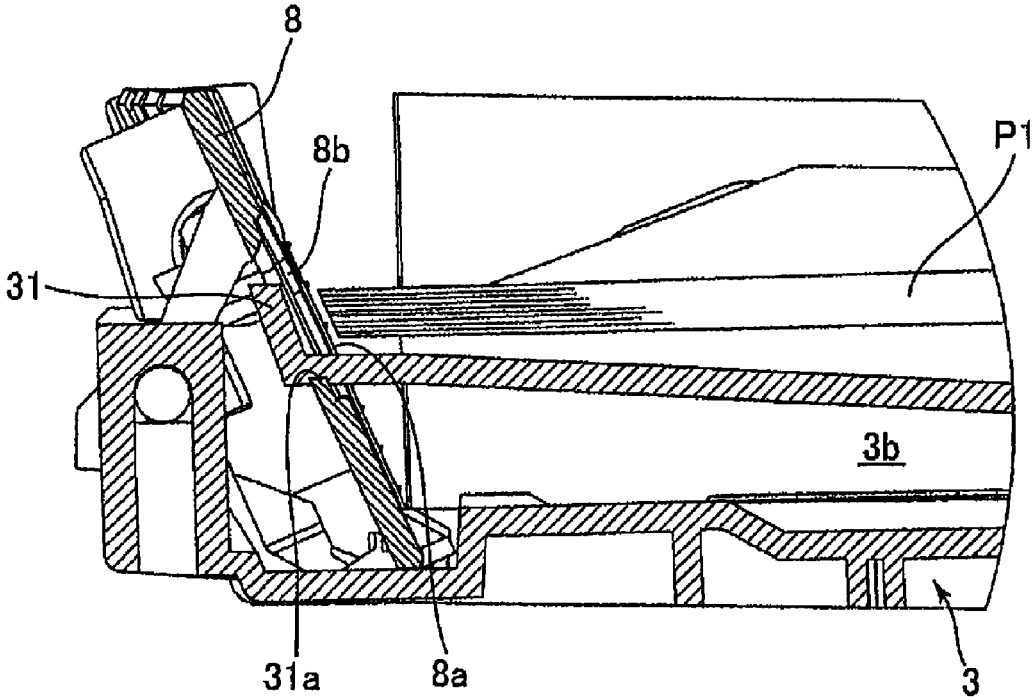
FIG. 6 is an enlarged side cross-sectional view showing a locked state of the second sheet-feeding cassette with a first sheet-feeding cassette.

As shown in FIG. 4, a pair of locking pieces 31 shaped like a hook facing upward is provided at the rear end of the first accommodating section 50 so as to protrude rearward. The locking pieces 31 are provided on both sides of the elastic separating pad 8*a* at an appropriate interval in the width direction Y. As shown in FIG. 6, a recessed part 31*a* is formed in a lower surface of each locking piece 31. When the second sheet-feeding cassette 30 is inserted as far as the sheet feeding position, the locking pieces 31 fit into positioning holes 8*b* formed through the main inclined separating plate 8, and the recessed parts 31*a* of the locking pieces 31 are locked at lower edges of the positioning holes 8*b*. In this manner, the second sheet-feeding cassette 30 is held at the sheet feeding position without any rattle. That is, the second sheet-feeding cassette 30 is prevented from displacing in the vertical and width directions and also from slanting, stabilizing the positioning of the second sheet-feeding cassette 30. The engagement between the locking pieces .31 and the positioning holes 8*b* (between the second sheet-feeding cassette 30 and the main inclined separating plate 8) is rapidly released when the second sheet-feeding cassette 30 is retracted to the sheet non-feeding position.

Since the accommodating section 30*a* of the second sheet-feeding cassette 30 is located to confront the elastic separating pad 8*a* of the main inclined separating plate 8 in the paper conveying direction A, the sheet supply roller 6*b* and the main inclined separating plate 8 can commonly be used for separating and feeding both the paper P and P1 accommodated on the first and second sheet-feeding cassette 3 and 30, respectively.

In association with the advancing and retracting of the first sheet-feeding cassette 3 and the second sheet-feeding cassette 30, the sheet supply roller 6*b* moves upward and downward as follows.

As shown in FIG. 4, the cam follower member 43 is formed integrally with the sheet supply arm 6*a* and protrudes from the sheet supply arm 6*a* in parallel with the drive shaft 6*d*. As shown in FIG. 7(*a*), an auxiliary cam portion 44 having sections with different heights is formed on an upper surface of one of the guide members 51*a* of the second sheet-feeding cassette 30. A main cam portion 55 having sections with different heights is formed on an upper surface of one of the side plates 3*c* of the first sheet-feeding cassette 3. As shown in FIG. 4, the cam follower member 43 extends over the auxiliary cam portion 44, and an end 43*a* of the cam follower member 43 contacts the main cam portion 55.

When the first sheet-feeding cassette 3 is inserted into the housing 2 integrally with the second sheet-feeding cassette 30, the end 43*a* of the cam follower member 43 gets onto the main cam portion 55 from the front edge of the one of the side plates 3*c* of the first sheet-feeding cassette 3 and is guided on the main cam portion 55 regardless of whether the second sheet-feeding cassette 30 is located at the sheet feeding position or the sheet non-feeding position.

By being guided by the main cam portion 55, the sheet supply arm 6*a* pivots upward to be nearly horizontal so that the sheet supply roller 6*b* gets over the main inclined separating plate 8, and subsequently the sheet supply arm 6*a* pivots downward so that the sheet supply roller 6*b* comes into contact with the uppermost one of the sheets of paper P1 or P stacked on either the second sheet-feeding cassette 30 or the first sheet-feeding cassette 3.

When the second sheet-feeding cassette 30 is moved from the sheet non-feeding position to the sheet feeding position while the first sheet-feeding cassette 3 is being at a predetermined position (sheet feeding position) within the housing 2, the cam follower member 43 contacts and slidingly moves along the auxiliary cam portion 44 of the second sheet-feeding cassette 30, and the sheet supply arm 6*a* pivots upward and then downward. As a result, the sheet supply roller 6*b* comes into contact with the uppermost sheet of paper P1 in the second sheet-feeding cassette 30. On the contrary, when the second sheet-feeding cassette 30 is moved from the sheet feeding position to the sheet non-feeding position while the first sheet-feeding cassette 3 is being at the predetermined position within the housing 2, the cam follower member 43 contacts and slidingly moves along the auxiliary cam portion 44, and the sheet supply arm 6*a* pivots upward and then downward, Thus, the sheet supply roller 6*b* comes into contact with the uppermost sheet of paper P in the first sheet-feeding cassette 3 without knocking down the stack of sheets of paper P1 on the second sheet-feeding cassette 30.

As described above, the sheet supply roller 6*b* contacts the paper P in the first sheet-feeding cassette 3 when the second sheet-feeding cassette 30 is located at the sheet non-feeding position, and the sheet supply roller 6*b* contacts the paper P1 in the second sheet-feeding cassette 30 when the second sheet-feeding cassette 30 is located at the sheet feeding position. Note that paper P and P1 is not shown in FIGS. 5(*a*) and 5(*b*).

With the above configuration, it is possible to attach the sheet-feeding cassettes 3 and 30 within the housing 2 while a large number of sheets of paper P are stacked in the accommodating section 3*b* of the first sheet-feeding cassette 3 and a large number of sheets of paper P1 are stacked on the accommodating section 30*a* of the second sheet-feeding cassette 30. If the second sheet-feeding cassette 30 is pushed to the sheet feeding position close to the end of the first sheet-feeding cassette 3 while both the sheet-feeding cassettes 3 and 30 are attached within the housing 2, the sheet supply roller 6*b* comes into pressed contact with the uppermost sheet of paper P1 in the second sheet-feeding cassette 30 and becomes capable to feeding the uppermost paper P1. This enables the printing on the paper P1. On the other hand, if the second sheet-feeding cassette 30 is returned to the sheet non-feeding position, then the sheet supply roller 6*b* comes into pressed contact with the uppermost sheet of paper P in the first sheet-feeding cassette 3 and becomes capable of feeding the uppermost paper P. This enables the printing on the paper P. That is, the sheet to be formed with images can be changed without performing such complicated operations as removing the sheet-feeding cassettes 3 and 30 from the housing 2 and detaching the sheet-feeding cassette 30 from the sheet-feeding cassette 3.

A pressing force from the sheet supply roller 6*b* is applied to the first accommodating section 50 when the sheet supply roller 6*b* presses against the paper P1 in the second sheet-feeding cassette 30. Since the first accommodating section 50 does not displace, the first accommodating section 50 can be formed to have sufficient rigidity so as not to be deformed due to the pressing force from the sheet supply roller 6*b*, maintaining the sheet supply performance. Thus, since there is no danger that the first accommodating section 50 is deformed due to the pressing force and the accommodating section 30*a* becomes unstable, the paper P1 can be fed with high accuracy without impairing sheet feeding performance. Furthermore, since the locking pieces 31 are provided at the first accommodating section 50 having high rigidity, stability in the engagement between the locking pieces 31 and the main inclined separating plate 8 can be improved. However, since the second accommodating section 51 merely pivots while supporting the paper P1 and does not require high rigidity as the first accommodating section 50 does, the first accommodating section 50 can be formed to be light in consideration of displacability thereof.

With the above configuration, the sheet supply unit 6 is partially accommodated in an internal space of the main frame 21 through an opening 21*c* formed in the bottom plate 21*b* when the sheet supply unit 6 is pivoted upward as shown in FIG. 2, and the cam follower member 43 is in contact with or close to a lower surface of the bottom plate 21*b*. This configuration allows the sheet supply unit 6 to pivot upward and downward without increasing the distance in the vertical direction between the bottom plate 21*b* of the main frame 21 and the second sheet-feeding cassette 30. In other words, the distance in the vertical direction between the bottom plate 21*b* and the first sheet-feeding cassette 3 can be short, thereby providing the compact image-forming device 1 having a small height.

Next, an image-forming device according to second illustrative aspects of the invention will be described with reference to FIGS. 9 to 11(*b*). The following description focuses on points of the construction according to the second illustrative aspects that differ from the construction according to the above first illustrative aspects.

Figure 9:
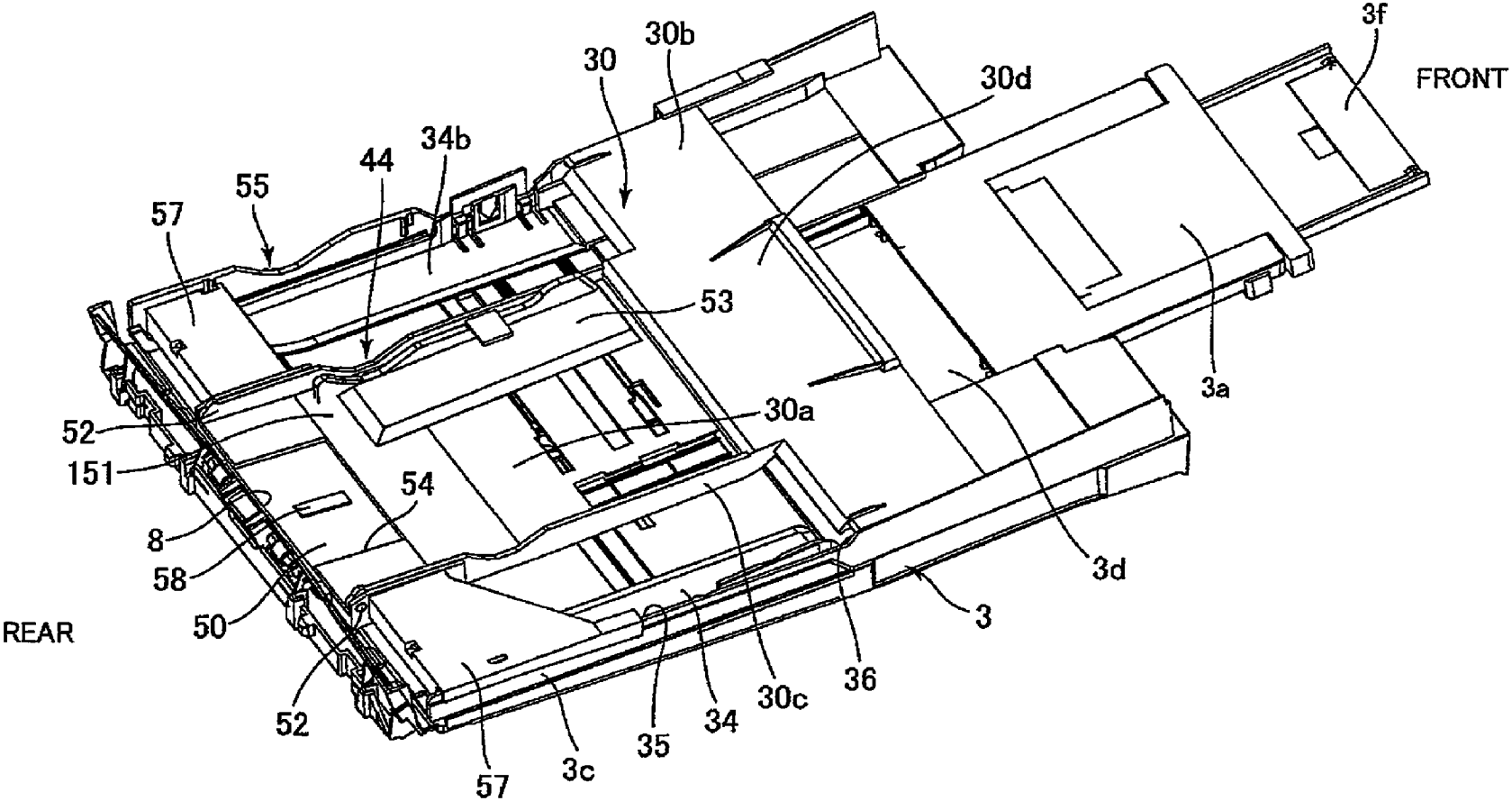
FIG. 9 is a perspective view of a first sheet-feeding cassette and a second sheet-feeding cassette at a sheet feeding position according to second illustrative aspects of the invention.
Figure 11A:
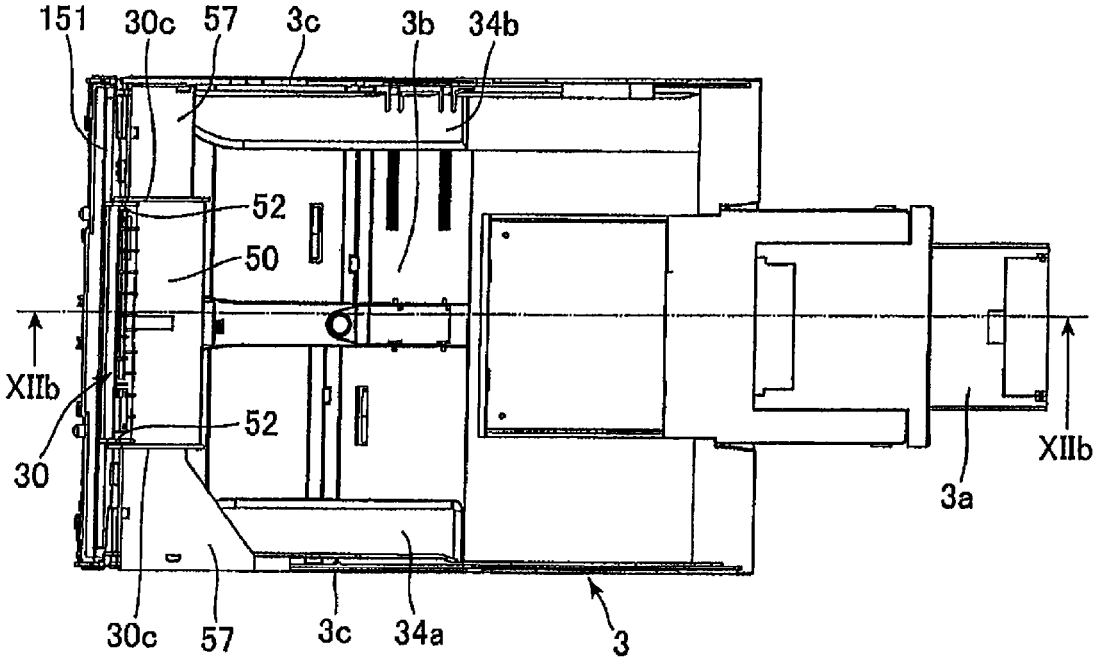
FIG. 11(*a*) is a plan view of the first sheet-feeding cassette and the second sheet-feeding cassette at the sheet feeding position with the first accommodating section at the open position, according to the second illustrative aspects of the invention.
Figure 11B:
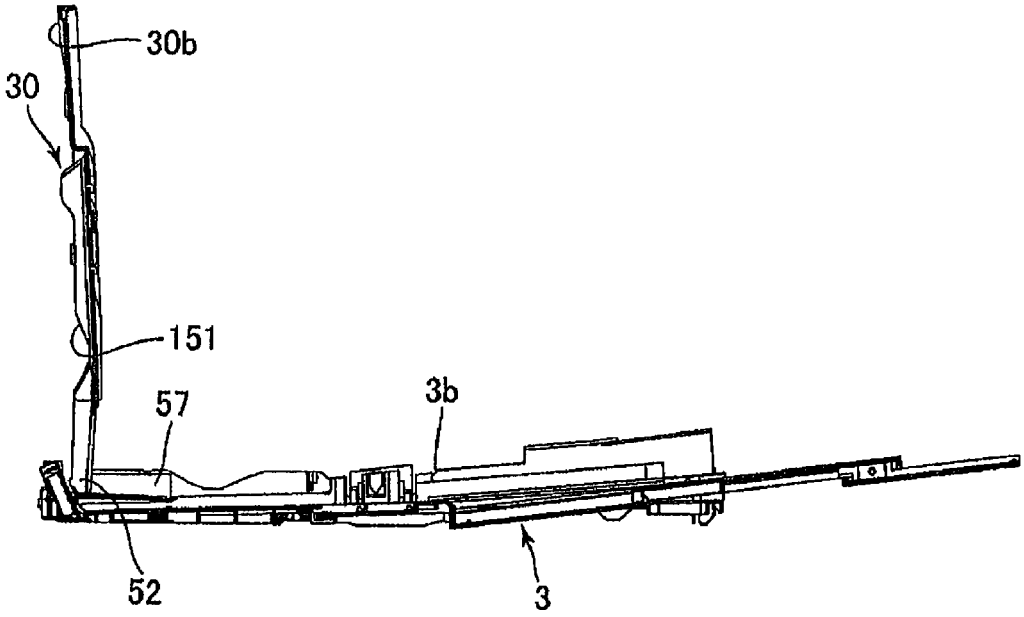

In the second illustrative aspects, as shown in FIG. 9 and FIG. 11(*a*), a second accommodating section 151 is configured to be pivotable about the hinges 52 disposed at the downstream end of the second sheet-feeding cassette 30 in the paper conveying direction A. Since the first accommodating section 50 is disposed at the downstream side of the accommodating section 30*a* in the paper conveying direction A, an opening 54 through which the first accommodating section 50 is exposed to the sheet supply roller 6*b* side is formed in the second accommodating section 151. Thus, the pressing force from the sheet supply roller 6*b* is reliably received at the first accommodating section 50 via the opening 54.

Figure 10:
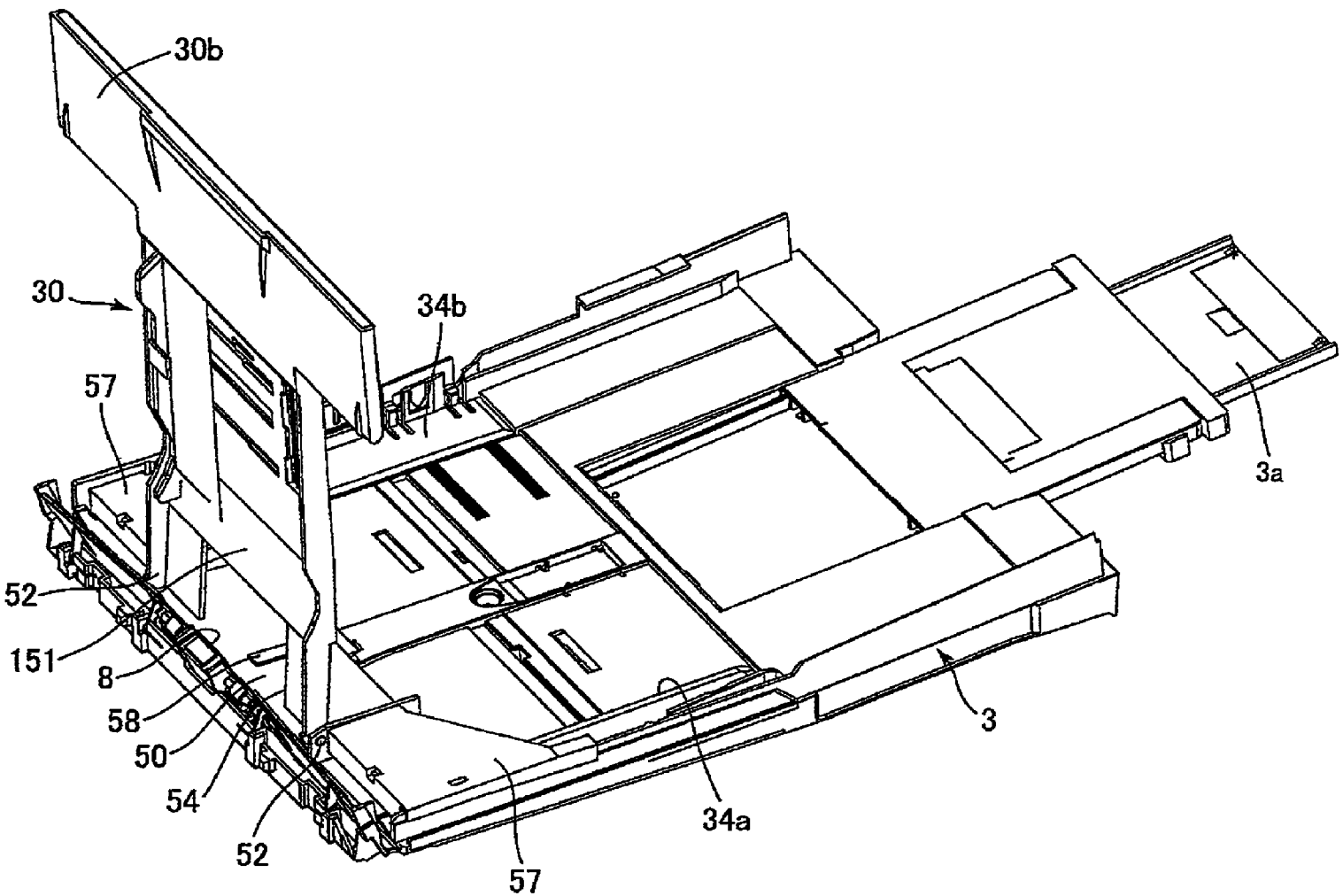
FIG. 10 is a perspective view of the first sheet-feeding cassette and the second sheet-feeding cassette at the sheet feeding position with a first accommodating section at an open position, according to the second illustrative aspects of the invention.

With this configuration, as shown in FIG. 10 and FIG. 11(*b*), when the second accommodating section 151 pivots to the open position, the paper P1 entirely is supported by the second accommodating section 151 and raised to be inclined in a substantial straight direction from the front end to the rear end of the paper P1. For this reason, even when the second accommodating section 151 pivots to the open position, there is no danger that the paper P1 is bent or slips out of the second accommodating section 151. Thus, the paper P1 is stably supported.

As shown in FIG. 10, a base pad 58 is disposed on the first accommodating section 50 at a position corresponding to a position at which the sheet supply roller 6*b* contacts the paper P1. The base pad 58 is formed of such a material as a cork or the like having larger frictional resistance than that of the other areas of the first accommodating section 50. Thus, rotation of the sheet supply roller 6*b* is reliably transmitted to even a last sheet of the paper P1 in the second sheet-feeding cassette 30.

While the invention has been described in detail with reference to the above aspects thereof, it would be apparent to those skilled in the art that various changes and modifications may be made therein without departing from the spirit of the invention.

For example the base pad 58 may be provided at the first accommodating section 50 of the image-forming device 1 according to the first illustrative aspects.

In the above illustrative aspects, the pressing force of the sheet supply roller 6*b* is received at the first accommodating section 50. However, the pressing force of the sheet supply roller 6*b* may be received at the second accommodating section 50, 150 instead.

What is claimed is:

1. A sheet feeder comprising:

a first cassette comprising an accommodating section that is capable of accommodating a stack of first recording medium;

a feed roller that feeds the first recording medium one sheet at a time in a feeding direction; and a second cassette disposed on the first cassette above the accommodating section, the second cassette configured to move with respect to the first cassette between a first position and a second position downstream of the first position with respect to the feeding direction, the second cassette comprising a mounting section capable of holding a stack of second recording medium having a size different from a size of the first recording medium, wherein the feed roller contacts the second recording medium held by the second cassette when the second cassette is located at the second position;

the mounting section of the second cassette comprises a first portion and a second portion, the second portion being displaceable relative to the first portion between a closed position and an open position, wherein the second portion exposes the accommodating section wider in the open position than in the closed position and both the first portion and the second portion move with respect to the first cassette between the first position and the second position; and the first portion is capable of engaging with and disengaging from the first cassette.

2. The sheet feeder according to claim 1, wherein the first portion is disposed at a downstream side of the mounting section in the feeding direction, and the second portion is pivotable about a hinge having a shaft extending in a direction perpendicular to the feeding direction such that a top side of the accommodating section is opened wider on an upstream side than a downstream side with respect to the feeding direction.

3. The sheet feeder according to claim 2, wherein the hinge is disposed upstream of the first portion in the feeding direction, and the second portion is connected to the first portion via the hinge and is disposed adjacent to an upstream end of the first portion in the feeding direction.

4. The sheet feeder according to claim 1, wherein the second cassette has a receiving unit that is integrally formed with the second portion so as to be continuous with an upstream end of the second portion in the feeding direction.

5. The sheet feeder according to claim 1, wherein the second cassette is attached to the first cassette so as to be slidingly movable in the feeding direction with respect to the first cassette but undetachable from the first cassette.

6. The sheet feeder according to claim 1, wherein a high-resistance member is disposed on the mounting section at a position corresponding to a contact position with the feed roller, the high-resistance member having a larger frictional resistance than a frictional resistance of other areas of the mounting section.

7. The sheet feeder according to claim 1, further comprising a mechanism that prevents the second cassette from slidingly moving further upstream than the first position in the feeding direction with respect to the first cassette.

8. The sheet feeder according to claim 1, further comprising a moving mechanism that moves the feed roller upward and downward in association with the movement of the second cassette in the feeding direction.

9. The sheet feeder according to claim 1, further comprising a separation pad disposed on the first cassette, the separation pad being capable of contacting the first recording medium and the second recording medium.

10. The sheet feeder according to claim 1, wherein the first recording medium is larger in size than the second recording medium.

11. The sheet feeder according to claim 1, wherein the first portion receives a pressing force of the feed roller when the feed roller contacts the second recording medium.

12. A sheet feeder comprising:

a first cassette having an accommodating section that is capable of accommodating a stack of first recording medium;

a feed roller that feeds the first recording medium one sheet at a time in a feeding direction;

and a second cassette disposed on the first cassette above the accommodating section so as to be movable with respect to the first cassette between a first position and a second position downstream of the first position with respect to the feeding direction, the second cassette having a mounting section capable of holding a stack of second recording medium having a size different from a size of the first recording medium, wherein the feed roller contacts the second recording medium held by the second cassette when the second cassette is located at the second position;

the mounting section of the second cassette has a first portion and a second portion, the second portion being displaceable relative to the first portion between a closed position and an open position, wherein the second portion exposes the accommodating section wider in the open position than in the closed position; and the first portion is capable of engaging with and disengaging from the first cassette, wherein the first portion is disposed at a downstream side of the mounting section in the feeding direction, and the second portion is pivotable about a hinge having a shaft extending in a direction perpendicular to the feeding direction such that a top side of the accommodating section is opened wider on an upstream side than a downstream side with respect to the feeding direction and wherein the hinge is disposed at a downstream end of the second cassette in the feeding direction, and the second portion is disposed nearer the feed roller than the first portion and is formed with an opening that allows the first portion to be exposed to a feed roller side.

13. An image-forming device comprising:

a casing;

a recording unit disposed within the casing, the recording unit forming an image on a recording medium;

a cassette detachably attachable to the casing below the recording unit, the cassette including:

a first cassette comprising an accommodating section that is capable of accommodating a stack of first recording medium; and a second cassette disposed on the first cassette above the accommodating section, the second cassette configured to move with respect to the first cassette between a first position and a second position downstream of the first position with respect to a feeding direction, the second cassette comprising a mounting section capable of holding a stack of second recording medium having a size different from a size of the first recording medium; and a feed roller that feeds the first recording medium and the second recording medium in the feeding direction toward the recording unit, wherein the feed roller contacts the first recording medium held by the first cassette when the second cassette is located at the first position;

the feed roller contacts the second recording medium held by the second cassette when the second cassette is located at the second position;

the mounting section of the second cassette comprises a first portion and a second portion, the second portion being displaceable relative to the first portion between a closed position and an open position, wherein the second portion exposes the accommodating section wider in the open position than in the closed position and both the first portion and the second portion move with respect to the first cassette between the first position and the second position; and the first portion is capable of engaging with and disengaging from the first cassette.

14. The image-forming device according to claim 13, further comprising a moving mechanism that moves the feed roller upward and downward in association with the attachment and detachment of the cassette.

15. The image-forming device according to claim 13, wherein the first portion receives a pressing force of the feed roller when the feed roller contacts the second recording medium.

16. A sheet feeder comprising:

a first cassette comprising an accommodating section configured to accommodate a first recording medium;

a feed roller that feeds the first recording medium in a feeding direction; and a second cassette disposed on the first cassette above the accommodating section, the second cassette configured to move with respect to the first cassette between a first position and a second position downstream of the first position with respect to the feeding direction, the second cassette comprising a mounting section configured to hold a second recording medium, wherein the feed roller contacts the second recording medium held by the second cassette when the second cassette is located at the second position; and the mounting section of the second cassette comprises a first portion and a second portion, the second portion being displaceable relative to the first portion between a closed position and an open position, wherein the second portion exposes the accommodating section wider in the open position than in the closed position and both the first portion and the second portion move with respect to the first cassette between the first position and the second position.

17. The sheet feeder according to claim 16, wherein the second portion further comprises a side-regulating plate that contacts the second recording medium and that defines a position of the second recording medium in a width direction.

18. The sheet feeder according to claim 16, wherein the first cassette comprises a first engaging portion and the second cassette comprises a second engaging portion that engages with the first engaging portion, wherein one of the first engaging portion and the second engaging portion includes a groove in which the other one of the first engaging portion and the second engaging portion slides.

19. The sheet feeder according to claim 16, wherein the first portion is disposed at a position downstream of the second portion with respect to the feeding direction.

20. The sheet feeder according to claim 16, wherein both the first portion and the second portion hold the stack of second recording medium when the second portion is located at the closed position.

21. The sheet feeder according to claim 16, wherein the second portion is displaceable relative to the first portion between the closed position and the open position both when the second cassette is located at the first position and when the second cassette is located at the second position.

22. The sheet feeder according to claim 16, wherein the second portion is displaceable relative to the first portion between the closed position and the open position when the second cassette is located at a third position between the first position and the second position.

* * * * *